US006874323B2

(12) United States Patent
Stuttaford

(10) Patent No.: US 6,874,323 B2
(45) Date of Patent: Apr. 5, 2005

(54) LOW EMISSIONS HYDROGEN BLENDED PILOT

(75) Inventor: Peter J. Stuttaford, Jupiter, FL (US)

(73) Assignee: Power System MFG., LLC, Jupiter, FL (US)

( * ) Notice: Subject to any disclaimer, the term of this patent is extended or adjusted under 35 U.S.C. 154(b) by 0 days.

(21) Appl. No.: 10/378,984

(22) Filed: Mar. 3, 2003

(65) Prior Publication Data

US 2004/0172949 A1 Sep. 9, 2004

(51) Int. Cl.[7] ..... F23R 3/34
(52) U.S. Cl. ..... 60/776; 60/39.465
(58) Field of Search ..... 60/772, 776, 737, 60/39.12, 39.463, 39.465

(56) References Cited

U.S. PATENT DOCUMENTS 3,446,012 A * 5/1969 Foster-Pegg ..... 60/39.12
4,292,801 A * 10/1981 Wilkes et al. ..... 60/776
4,982,570 A * 1/1991 Waslo et al. ..... 60/737
5,216,876 A * 6/1993 Gabrielson et al. ..... 60/772
6,164,055 A * 12/2000 Lovett et al. ..... 60/776
6,298,652 B1 * 10/2001 Mittricker et al. ..... 60/39.12
6,523,351 B2 * 2/2003 Mittricker et al. ..... 60/39.12
6,585,784 B1 * 7/2003 Mittricker ..... 48/127.3
6,722,132 B2 * 4/2004 Stuttaford et al. ..... 60/737

* cited by examiner

*Primary Examiner*—Michael Koczo, Jr.
(74) *Attorney, Agent, or Firm*—Brian R. Mack; Christopher T. Hayes

(57) ABSTRACT

A method of operating a gas turbine combustor to achieve overall lower emissions of nitrous oxides by supplying a mixture of natural gas and hydrogen gas to the combustion chamber of the gas turbine in a manner that the localized concentration of hydrogen gas is greater than 0.1% by mass of the mass of the mixture, and less than 20.0% by mass of the mixture prior to combusting the mixture in the combustion chamber.

5 Claims, 1 Drawing Sheet

LOW EMISSIONS HYDROGEN BLENDED PILOT

BACKGROUND OF THE INVENTION

1. Field of the Invention

This invention relates to gas turbine combustors and more specifically to a method of operating such a gas turbine so as to reduce emissions of nitrous oxides.

2. Description of Related Art

In an effort to reduce the amount of pollution emissions from gas-powered turbines, governmental agencies have enacted numerous regulations requiring reductions in the amount of emissions, especially nitrogen oxide (NOx) and carbon monoxide (CO). Lower combustion emissions can be attributed to a more efficient combustion process, with specific regard to fuel injectors and nozzles. Early combustion systems utilized diffusion type nozzles that produce a diffusion flame, which is a nozzle that injects fuel and air separately and mixing occurs by diffusion in the flame zone. Diffusion type nozzles produce high emissions due to the fact that the fuel and air burn stoichiometrically at high temperature to maintain adequate combustor stability and low combustion dynamics.

An enhancement in fuel injector technology over diffusion nozzles is the utilization of some form of premixing, such that the fuel and air mix prior to combustion to form a homogeneous mixture that burns at a lower temperature than a diffusion type flame and produces lower NOx emissions. Premixing can occur either internal to the fuel nozzle or external thereto, as long as it is upstream of the combustion zone. While combustion systems having premixing technology can lower emissions, the lower flame temperature associated with the premixing can cause flame stability and combustion dynamics issues.

What is needed is a system that can provide the benefits of flame stability and low combustion dynamics associated with the diffusion type nozzles with the low emissions benefits of the premix type nozzles.

SUMMARY AND OBJECTS OF THE INVENTION

The present invention seeks to overcome the shortfalls of the prior art by providing a method of operating a gas turbine combustor to achieve overall lower emissions of nitrous oxides by supplying a mixture of natural gas and hydrogen gas to the combustion chamber of the gas turbine in a manner that the localized concentration of hydrogen gas is greater than 0.1% by mass of the mass of the mixture, and less than 20.0% by mass of the mixture prior to combusting the mixture in the combustion chamber.

It is an object of the present invention to reduce nitrous oxide emissions produced by operation of gas turbine engines.

It is a further object of the present invention to reduce nitrous oxide emissions in existing gas turbines without significant retrofitting of the hardware currently in use on such gas turbine engines.

In accordance with these and other objects, which will become apparent hereinafter, the instant invention will now be described with particular reference to the accompanying drawings.

DETAILED DESCRIPTION OF THE PREFERRED EMBODIMENT

Figure 1:
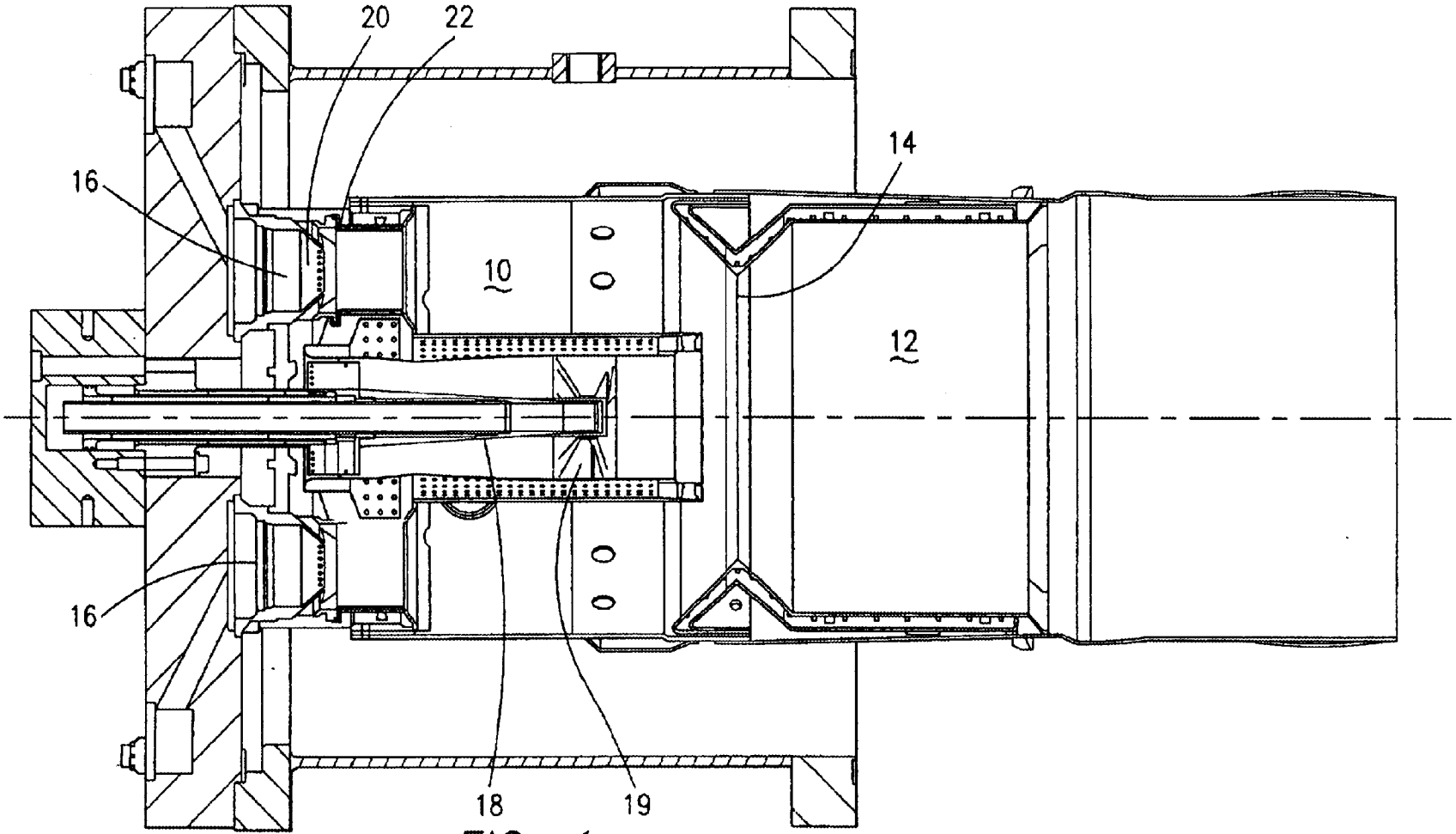
FIG. 1 is a cross section view of a gas turbine combustor of the type that may be used in the method of the present invention.

As shown in FIG. 1 herein, a typical combustor comprises a primary or upstream combustion chamber 10 and a second or downstream combustion chamber 12 separated by a venturi throat region 14. Primary nozzles 16 provide fuel delivery to the upstream combustor 10 and are arranged in an annular array around a secondary nozzle 18, which is located along the combustor centerline. A typical combustor may include six primary nozzles 16 and one secondary nozzle 18, and fuel, in the form of natural gas, is delivered to the nozzles through in a manner well known in the art and filly described in U.S. Pat. Nos. 4,292,801 and 4,982,570, which are hereby incorporated by reference into this specification. Ignition in the primary combustor is caused by spark plug not shown in FIG. 1 and in adjacent combustors by means of crossfire tubes, also not shown, but well known in the art.

The fuel nozzles, both primary and secondary, may be identical to one another as disclosed in the U.S. Pat. No. 4,292,801 (i.e. the nozzles are all of the diffusion type). A diffusion nozzle 16 includes a fuel delivery nozzle 20 and an annular swirler 22. The nozzle 20 delivers only fuel, which is then subsequently mixed with swirler air for combustion. Alternatively, the primary fuel nozzles may be identical to one another (i.e. the nozzles are all of the diffusion type) but the secondary may be a different type that incorporates a premixing type nozzle, a diffusion type nozzle, or both as disclosed in U.S. Pat. No. 4,982,570. For further fuel-air mixing adjacent secondary nozzle 18, it is desirable to have a secondary swirler 19 encompass secondary nozzle 18 as shown in FIG. 1.

During base-load operation, combustors such as the one shown in FIG. 1 are designed to operate in a premix mode such that all of the primary nozzles are simply mixing fuel and air to be ignited by the diffusion flame supported by the secondary nozzle. This premixing of the primary nozzle fuel and ignition by the secondary diffusion nozzle reduces the nitrous oxides ("NOx") output from the combustor. However, current secondary fuel nozzles that incorporate a diffusion type nozzle still experience relatively high NOx production in the vicinity of the diffusion nozzle. This continues to occur even when utilizing the minimum possible percentage of fuel in the secondary nozzle's diffusion nozzle, because the fuel provided by the secondary nozzle must always produce sufficient heat input to satisfactorily burn the main premixed flow at other operating conditions.

The applicant has discovered that NOx emissions can be further reduced by providing at least one fuel nozzle upstream from the combustion chamber for introducing fuel into the first combustion chamber and supplying a mixture of fuel to said combustion chamber through said at least one fuel nozzle in which the fuel comprises natural gas and hydrogen gas. The fuel is introduced into the combustion chamber in such a manner as to create localized concentrations of hydrogen gas in the combustion chamber in which the hydrogen gas in the mixture is greater than 0.1% by mass of the mass of said mixture, and less than 20.0% by mass of said mixture. In the case of a combustor having a secondary fuel combustion having a diffusion type nozzle, this can be achieved by providing the mixture containing hydrogen gas comprising greater than 0.1% by mass of the mass of said mixture, and less than 20.0% by mass of said mixture directly to the diffusion nozzle, or premixed nozzle, of the secondary fuel nozzle. When this mixture is subsequently combusted in the combustion chamber, the NOx is reduced as a result of the lower flame temperature produced by the mixture of hydrogen gas and natural gas as compared to fuel containing only natural gas. More specifically, applicant has determined that the addition of hydrogen gas to the natural gas fuel allows gas turbine operation at reduced flame temperature, which in turn reduces NOx production. The addition of hydrogen allows stable operation at lower flame temperature due to the presence of a higher concentration of OH radicals in the flame. This allows more air to be introduced in the premixer while maintaining stable operation and adequate burnout of carbon monoxide.

While additions of hydrogen gas in amounts in excess of 0.1% by mass of the mixture provide benefits in NOx reduction, most of the benefits of adding hydrogen gas to the mixture are achieved by adding hydrogen gas in amounts up to 20.0% by mass of the mixture. Beyond this amount, the flame speed increases caused by the hydrogen gas additions require significant modifications to the typical combustion hardware to accommodate the higher flame speeds. In addition, since hydrogen gas typically costs about three (3) times the cost of natural gas, fuel mixtures having higher concentrations of hydrogen gas are likewise undesirable.

Although the invention has just been described in terms of a typical combustor having two combustion chambers and multiple fuel nozzles, those skilled in the art will readily appreciate that the method of the present invention can be practiced even in combustor having a single combustion chamber and a single fuel nozzle, as long as the hydrogen gas can be supplied to the combustion chamber in a manner that produces a local concentration of hydrogen gas so that localized concentrations of hydrogen gas in the mixture are greater than 0.1% by mass of the mass of said mixture, and less than 20.0% by mass of said mixture. For example, a small amount of hydrogen gas could be added asymmetrically in the manner known in the art, to produce a film of hydrogen gas and natural gas in which the concentration of hydrogen is within the range specified and claimed in this disclosure. This application is not limited to the specific mechanism for creating the desired localized concentration of hydrogen gas relative to the mixture, but rather to the use of a mixture of hydrogen gas and natural gas within the claimed range of concentrations to provide a stabilizing flame for the combustor that produces significantly less NOx than prior art methods of operating gas turbine combustors.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What I claim is:

1. A method of operating a gas turbine combustor comprising:

providing a combustor having upstream and downstream combustion chambers and a combustor centerline;

providing a secondary fuel nozzle along said combustor centerline for introducing fuel into said downstream combustion chamber;

providing a plurality of primary fuel nozzles in an annular array about said secondary fuel nozzle and upstream from said upstream combustion chamber for introducing a fuel into said upstream combustion chamber, each of said plurality of primary fuel nozzles including a primary swirler for introducing pressurized air into said upstream combustion chamber for creating a combustible fuel air mixture;

supplying a mixture of fuel to said downstream combustion chamber through said secondary fuel nozzle, said mixture comprising natural gas and hydrogen gas, wherein said mixture contains localized concentrations of hydrogen gas in which the hydrogen gas in said mixture is greater than 0.1% by mass of said mixture, and less than 20% by mass of said mixture; and, combusting said mixture in said downstream combustion chamber.

2. The method of claim 1 wherein said upstream and downstream combustion chambers are separated by a venturi throat region.

3. The method of claim 2 wherein said secondary fuel nozzle further comprises a secondary swirler encompassing said secondary fuel nozzle proximate said venturi throat region.

4. The method of claim 1 wherein said primary swirler of said primary fuel nozzle is located proximate said upstream combustion chamber.

5. The method of claim 1 wherein said fuel introduced by said primary fuel nozzles is natural gas.

* * * * *

UNITED STATES PATENT AND TRADEMARK OFFICE

CERTIFICATE OF CORRECTION

PATENT NO. : 6,874,323 B2
DATED : April 5, 2005
INVENTOR(S) : Peter J. Stuttaford It is certified that error appears in the above-identified patent and that said Letters Patent is hereby corrected as shown below:

Title page,
Item [73], Assignee, reads as "Power System MFG.,LLC." instead should read as -- Power Systems Mfg., LLC --

Signed and Sealed this

Seventh Day of June, 2005

JON W. DUDAS
*Director of the United States Patent and Trademark Office*